US005522565A

United States Patent [19]

Deshaies

[11] Patent Number: 5,522,565

[45] Date of Patent: Jun. 4, 1996

[54] ADJUSTABLE YARN PACKAGE HOLDER

[76] Inventor: Marcel R. Deshaies, P.O. Box 965, Sanford, N.C. 27330

[21] Appl. No.: 226,500

[22] Filed: Apr. 12, 1994

[51] Int. Cl.[6] ..... B65H 75/24; B65H 49/02

[52] U.S. Cl. ..... 242/575.2; 242/129.5; 242/131; 279/126

[58] Field of Search ..... 242/130, 130.1, 242/134, 131, 127, 575.2, 129.5; 279/2.01, 117, 126

[56] References Cited

U.S. PATENT DOCUMENTS

| | | | |
|---|---|---|---|
| 583,206 | 5/1897 | Atwood . | |
| 1,470,373 | 10/1923 | Barrier | 242/575.2 X |
| 1,894,556 | 1/1933 | Edlund . | |
| 2,930,542 | 3/1960 | Cocker, III . | |
| 3,064,921 | 11/1962 | Berkeley . | |
| 3,171,610 | 3/1965 | Hoch . | |
| 3,850,394 | 11/1974 | Raasch et al. . | |
| 3,897,915 | 8/1975 | Budzyna | 242/130.1 |
| 4,485,987 | 12/1984 | Simpson . | |
| 4,538,776 | 9/1985 | Perry | 242/131 |
| 4,558,833 | 12/1985 | Speck | 242/575.2 |
| 4,750,682 | 6/1988 | Elliott | 242/575.2 X |
| 5,170,979 | 12/1992 | Baber | 242/130.1 X |
| 5,383,621 | 1/1995 | Alexander | 242/130 |

*Primary Examiner*—Michael R. Mansen
*Attorney, Agent, or Firm*—Bell, Seltzer, Park & Gibson

[57] ABSTRACT

An adjustable yarn package holder which can support one of a plurality of variously sized yarn packages on a creel. The yarn package holder includes a pair of longitudinally adjustable elongate support arms which define a mandrel for receiving the core of a yarn package. The elongate support arms may be selectively moved between a first closely spaced apart position and a second widely spaced apart position to define different cross-sectional sizes of mandrels for receiving yarn packages having cores of different diameters. The support arms are fixed to respective guide arms which slideably engage opposing guide edges of a base plate. The guide arms preferably include opposing gear racks, and a rotatable pinion gear is positioned between and in engagement with the opposing gear racks. For moving the pinion gear, a pair of lever arms are fixed to and extend radially from the pinion gear, and the lever arms include provision whereby they may be releasably locked in a selected rotational position. Thus the support arms may be releasably locked in any one of a plurality of positions at or between the first closely spaced apart position and the second widely spaced apart position. Accordingly, the yarn package holder can be properly sized to receive any one of a plurality of yarn packages having differently sized cores.

15 Claims, 3 Drawing Sheets

ADJUSTABLE YARN PACKAGE HOLDER

FIELD OF THE INVENTION

This invention relates to yarn package holders which are adapted for use as part of a yarn creel.

BACKGROUND OF THE INVENTION

In various textile yarn processing operations, it is common to provide a creel which holds a large number of yarn packages in columns and rows, and so that a large number of yarns may be supplied from the packages to a textile processing machine. In some instances, several creels are provided so as to hold hundreds of packages for a single machine.

Each creel typically comprises a number of vertical posts, with each post mounting a number of vertically spaced apart and generally horizontal mandrels. The yarn packages, which comprise a tubular core or bobbin upon which the yarn is wound, are coaxially supported on respective ones of the mandrels, and so that the yarns may be freely withdrawn and advanced to the textile machine.

The mandrels of the creel have a fixed cross-sectional dimension, which is usually kept small, so that each mandrel will coaxially accept the smallest package, with the smallest core opening, that might possibly be used. Keeping the cross-sectional dimension of the mandrel small, however, results in any packages of a larger size being held loosely and off center. It is desirable that the center line of the packages be constant from one package size to the next, since alignment must be correct to avoid excessive tension, "ballooning", snagging, and possible breakage of the yarn.

One presently employed method for keeping yarn packages of varying core diameter centered on their respective mandrels is to coaxially place package tube adapters on the mandrels when packages of larger core diameter are to be supported. A common form of package tube adaptor is a sleeve which fits snugly over the mandrel, and which has an exterior dimension that snugly accepts the core of the yarn package. A series of sleeves may fit one onto another for changing the effective cross-sectional dimension of the mandrel. Another common form of package tube adaptor is a pair of core sections which are screwed onto the mandrel.

A problem with adapters for mandrels as described above is that they can be easily misplaced and lost. If the creel of a textile machine requires hundreds of sleeves for a particular production run, then misplacing a few sleeves can be a significant problem. In addition to the problems associated with lost adapters, textile mills must dedicate a large area of storage space for the hundreds of adapters needed for each creel. Funds are additionally lost in the time spent retrieving adapters from the storage area, fixing the adapters on the respective mandrels, and returning any replaced adapters to their appropriate storage area. Further, production facilities must be careful in the purchase and later handling of adapters to ensure a continuing compatibility with both the associated creel as well as the yarn packages.

It is accordingly an object of the present invention to provide an improved yarn package holder for a yarn creel.

It is another object of the present invention to provide a yarn package holder of the described type, which may be easily adjusted in size so as to properly accommodate and mount yarn packages of varying core diameters.

It is still another object of the invention to provide a yarn package holder which does not require the addition of adapters each time a differently sized yarn package needs to be placed on a mandrel.

It is also an object of the present invention to provide an adjustable yarn package holder which may be readily retrofitted too the posts of conventional creels in place of each of the original mandrels.

SUMMARY OF THE INVENTION

The above and other objects and advantages of the present invention are achieved by an adjustable yarn package holder which can be readily sized to support any one of a plurality of yarn packages having varying core diameters. More particularly, the yarn package holder according to the invention includes a base plate having a planar support surface, and a pair of elongate support arms which define a mandrel for receiving the tubular core of a yarn package. The support arms are mounted on the base plate so that they extend outwardly from the support surface of the base plate, and with at least one of the support arms being moveable toward and away from the other support arm. A gear mechanism is provided for longitudinally moving the one support arm. Thus, by manually moving the gear mechanism, the elongate support arms may be selectively moved between a first closely spaced apart position and a second widely spaced apart position to define different cross-sectional sizes of mandrels for receiving yarn packages having cores of different diameters.

In the preferred embodiment, the base plate includes a shoulder which defines a guide edge that is perpendicular to and extends longitudinally along one side of the base plate support surface. The one support arm is fixed to a guide arm which is parallel to and adjacent to the support surface of the base plate and has a side edge for slideably engaging the guide edge of the base plate. Another side edge, which faces away from the guide edge of the base plate, has a gear rack thereon.

The gear mechanism includes a pinion gear which is rotatably mounted to the base plate and positioned to engage the gear rack of the guide arm. Consequently, rotation of the pinion gear causes movement of the gear rack and the one support arm. For moving the pinion gear, a lever arm is fixed to and extends radially from the pinion gear. The lever arm defines a radial extremity which facilitates manual rotation of the pinion gear and thus movement of the one support arm between the first closely spaced apart position and the second widely spaced apart position.

A locking apparatus is preferably provided for releasably locking the one support arm in any one of a plurality of positions at or between the first closely spaced apart position and the second widely spaced apart position. Accordingly, the spacing between the elongate support arms may be selectively fixed to define a plurality of different cross-sectionally sized mandrels for receiving any one of a plurality of yarn packages having a plurality of differently sized cores.

The locking apparatus includes a surface segment on the base plate, a mounting block on the lever arm, and a spring plunger assembly attached to the mounting block. The surface segment, which is preferably a segment of a cylindrical surface, has a plurality of radial openings and is connected to the base plate. For example, the surface segment may take the form of a removable shoe plate so as to facilitate the removal and replacement of the shoe plate with one having a different pattern of radial openings. The mounting block is fixed to the radial extremity of the lever arm and positioned to overlie the surface segment, and the spring plunger assembly is mounted to the mounting block for selectively engaging one of the radial openings in the surface segment.

In the preferred embodiment, both elongate support arms are moveable toward and away from each other between the first closely spaced apart position and the second widely spaced apart position to define different cross-sectional sizes of mandrels. The associated gear mechanism controls movement of both support arms, and the locking apparatus releasably locks both of the support arms in any one of a plurality of positions located between the two extreme positions. Thus, both of the elongate support arms may be selectively fixed to define a plurality of different cross-sectionally sized mandrels for receiving yarn packages having differently sized cores.

Also in the preferred embodiment, a pair of lever arms are fixed to opposite sides of the pinion gear and extend radially in opposite directions to define two radial extremities. The radial extremity of either lever arm is moveable to cause rotation of the pinion gear and thereby move the elongate support arms. Also, the locking apparatus includes a pair of surface segments on the base plate, and a pair of mounting blocks and a pair of spring plunger assemblies associated with each surface segment. By this arrangement, a large number of radial openings may be positioned on the two surface segments to increase the number of fixed spacings of the support arms which may be selected.

BRIEF DESCRIPTION OF THE DRAWINGS

Some of the objects and advantages of the present invention having been stated, others will become apparent when considered in conjunction with the accompanying drawings, in which.

DETAILED DESCRIPTION OF THE PREFERRED EMBODIMENT

The present invention will now be described more fully hereinafter with reference to the accompanying drawings, in which a preferred embodiment of the invention is shown. This invention may, however, be embodied in many different forms and should not be construed as limited to the embodiment set forth herein; rather, this embodiment is provided so that this disclosure will be thorough and complete, and will fully convey the scope of the invention to those skilled in the art. Like numbers refer to like elements throughout.

Figure 1:
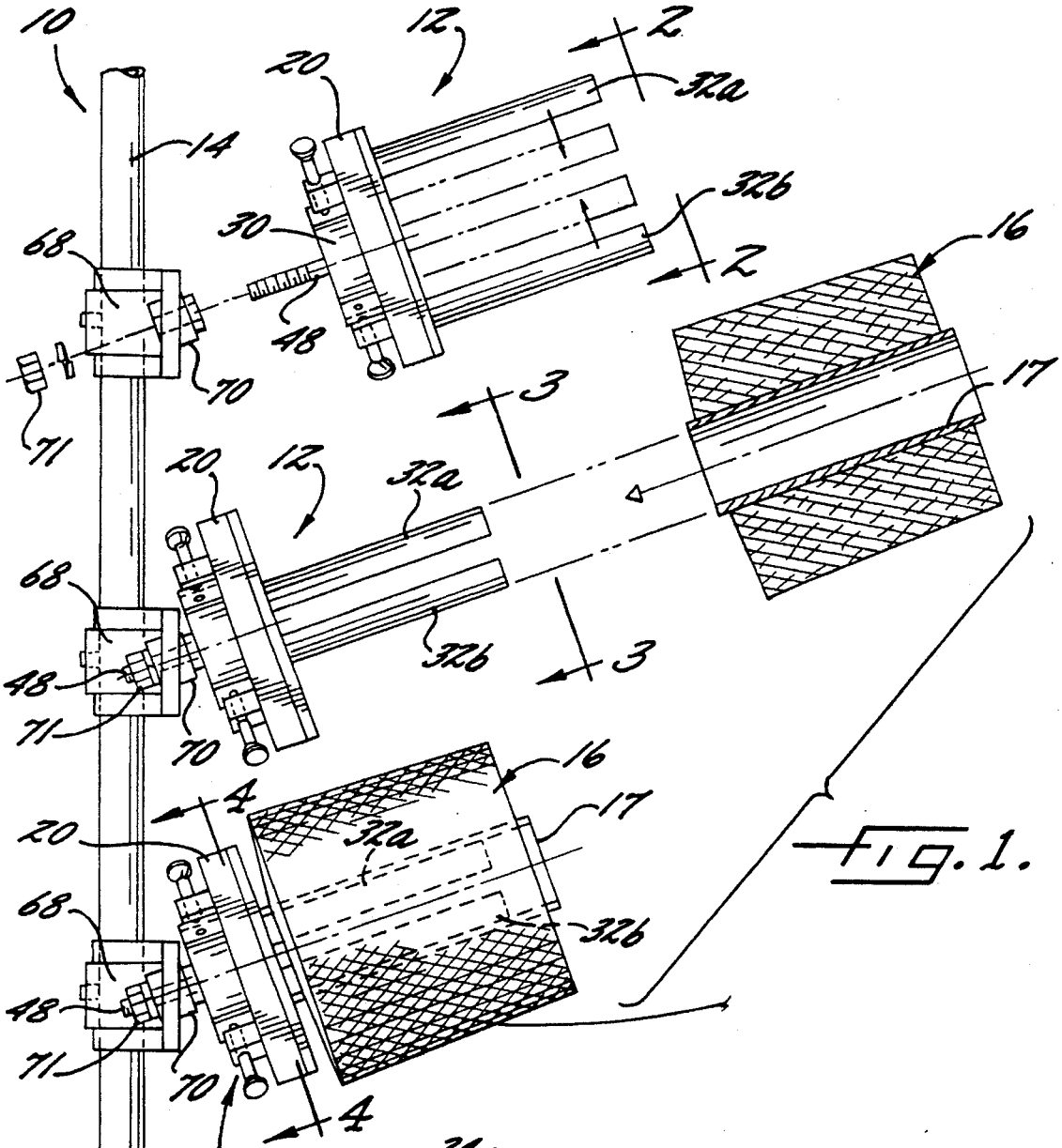
FIG. 1 is a fragmentary side elevation view of a yarn package supporting creel, and which includes adjustable yarn package holders according to the invention thereon.

FIG. 1 is a fragmentary side elevation view of a yarn package supporting creel 10, and which includes a plurality of yarn package holders 12 in accordance with the present invention. As is conventional, the creel includes a plurality of vertical posts 14, only one of which is illustrated, and each post 14 mounts a plurality of vertically spaced apart yarn package holders 12.

As will become apparent, each yarn package holder 12 is adjustable for supporting one of a plurality of variously sized yarn packages 16 on the creel 10. By adjusting each yarn package holder 12, yarn packages 16 which have tubular cores 17 of different diameters can be properly supported.

Figure 6:
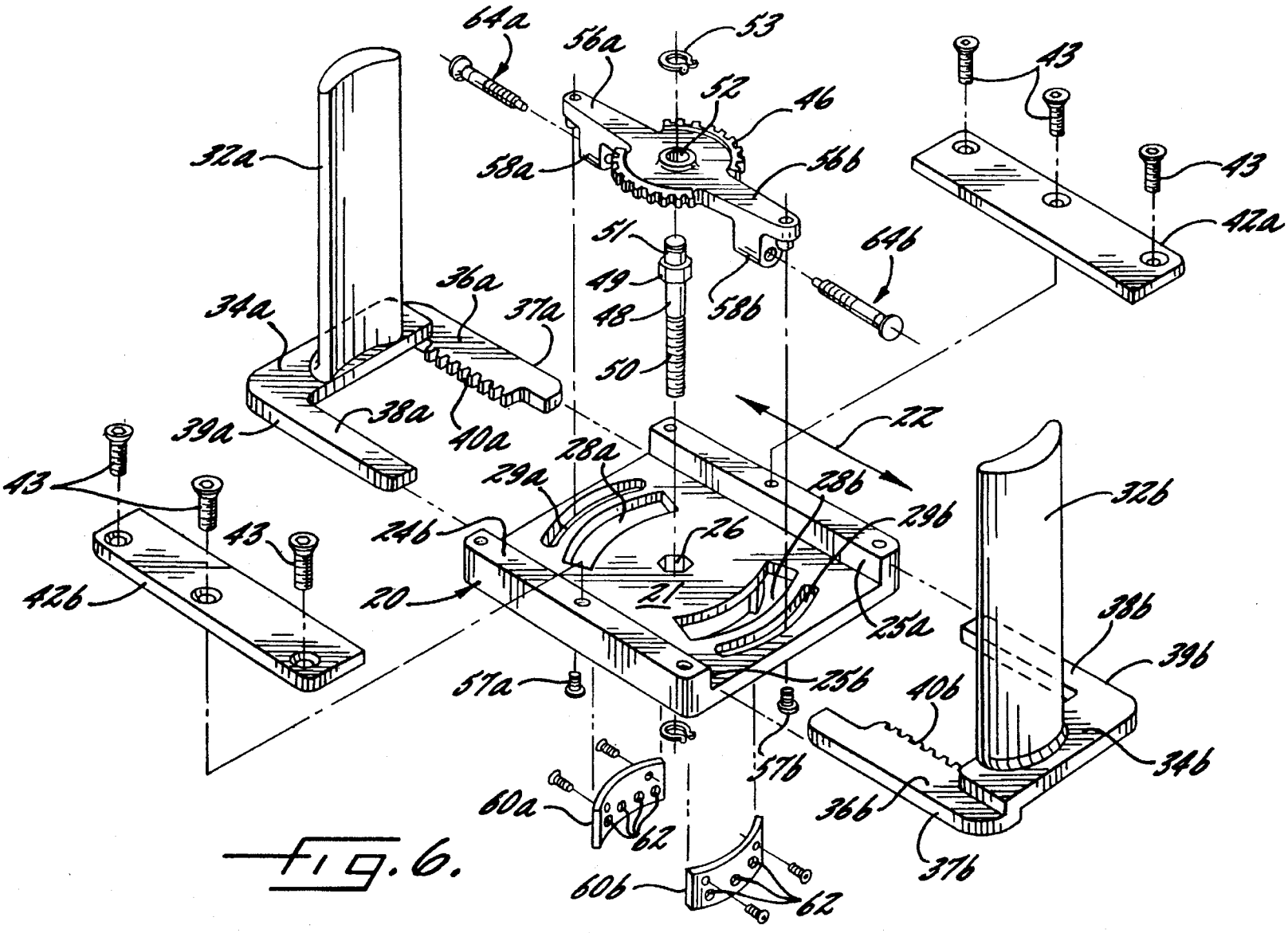
FIG. 6 is an exploded perspective view of the adjustable yarn package holder as shown in FIG. 1.

As seen most clearly in the exploded perspective view of FIG. 6, each holder 2 includes a base plate 20 which has a planar support surface which defines a longitudinal direction 22. The base plate 20 also has a pair of shoulders 24*a*, 24*b* along opposite sides of the support surface 21 so as to define a pair of opposing and parallel guide edges 25*a*, 25*b*. Each of the opposing guide edges 25*a*, 25*b* is perpendicular to the support surface 21 and extends longitudinally along an associated side of the base plate 20.

Figure 5:
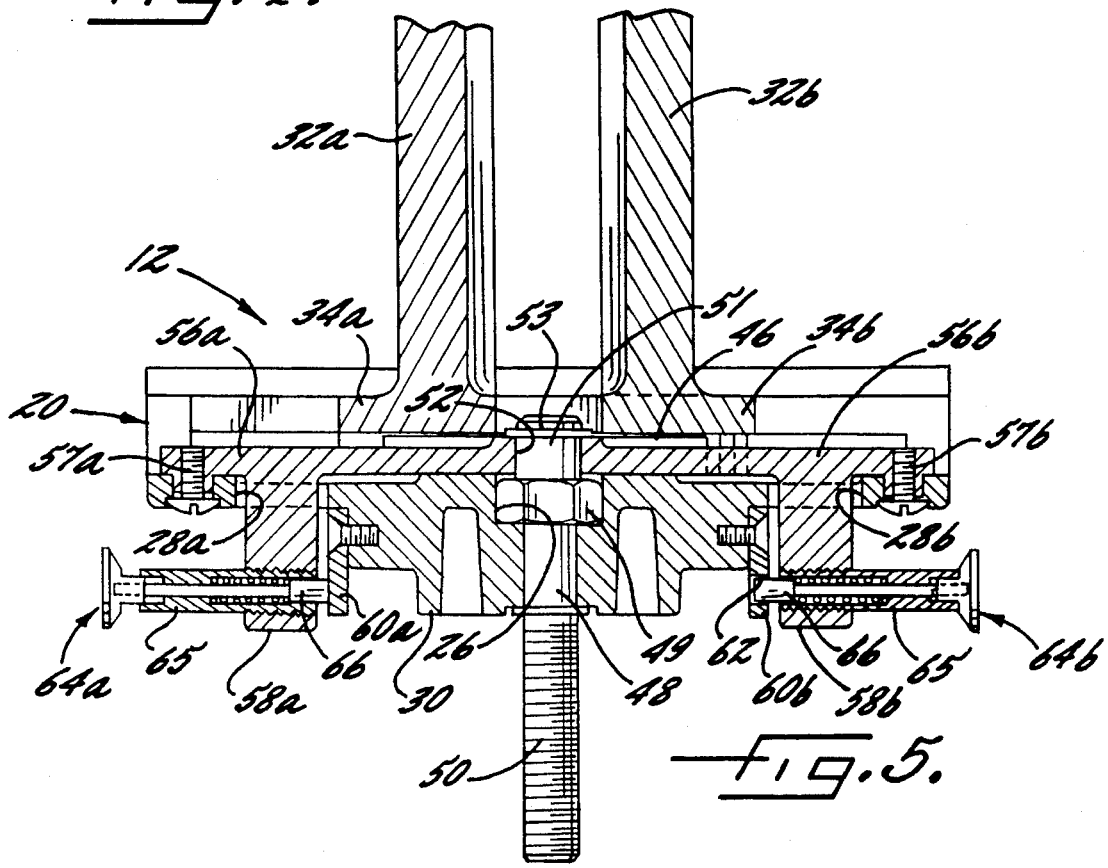
FIG. 5 is a cross-sectional view along the line 5—5 of FIG. 4 and illustrates the releasable locking apparatus according to the invention.

The planar support surface 21 of the base plate 20 includes a central opening 26 which extends therethrough, a first pair of arcuate openings 28*a*, 28*b* on opposite sides of the central opening 26, and a second pair of arcuate openings 29*a*, 29*b* on the outside of the first pair of openings, for the purposes described below. Also, the bottom surface of the base plate includes a cylindrical collar 30 which is concentric to the axis of the central opening 26 in the base plate, note FIG. 5.

Each yarn package holder 12 also includes a pair of outwardly extending elongate support arms 32*a*, 32*b* which together define a mandrel for receiving the tubular core 17 of a yarn package 16. The two support arms are at least about six inches in length, and preferably about eight inches in length, and they are each moveable longitudinally toward and away from each other in the manner further described below. Thus the elongate support arms 32*a*, 32*b* may be selectively moved between a first closely spaced apart position (note the dashed line position of the arms of the upper holder in FIG. 1) and a second widely spaced apart position (note the solid line position of the arms of the upper holder in FIG. 1) to define different cross-sectional sizes of mandrels for receiving yarn packages 16 having cores 17 of different diameters. The fact that both of the elongate support arms 32*a*, 32*b* are moveable between the first and second positions serves to maximize the cross-sectional size selection without affecting the center of the package 16 supported thereon.

The support arms 32*a*, 32*b* are each fixed in a conventional manner to one of a pair of U-shaped brackets 34*a*, 34*b*. Each U-shaped bracket 34*a*, 34*b* has a first guide arm 36*a*, 36*b* having a first longitudinally directed side edge 37*a*, 37*b* which directly opposes and slideably engages one of the guide edges 25*a*, 25*b* of the base plate 20. More particularly, the side edge 37*a* engages the guide edge 25*a*, and the side edge 37*b* engages the guide edge 25*b*. A second guide arm 38*a*, 38*b* of each bracket has a second longitudinally directed side edge 39*a*, 39*b* which directly opposes and slideably engages the other of the guide edges 25*a*, 25*b* of the base plate 20, with the side edge 39*a* engaging the guide edge 25*b* and the side edge 29*b* engaging the guide edge 25*a*.

The U-shaped brackets 34*a*, 34*b* partially overly each other and are disposed in oppositely directed orientations. More particularly, and as best seen in FIG. 6, the first guide arms 36*a*, 36*b* overlie and rest directly upon the support surface 21 of the base plate 20, and the second guide arms 38*a*, 38*b* overlie and rest upon the guide arms 36*b*, 36*a*, respectively. Also, the guide arms 36*a*, 36*b* have inner side edges which have longitudinal gear racks 40*a*, 40*b* formed thereon, and such that the two gear racks are parallel to each other and face each other at the same elevation above the support surface of the base plate.

The U-shaped brackets 34*a*, 34*b* are secured upon the support surface 21 of the base plate 20 by a pair of holder cap plates 42*a*, 42*b*. Each cap plate is secured by bolts 43 to one of the shoulders 24*a*, 24*b* so as to overlie respective ones of the second guide arms 38*b*, 38*a* of the U-shaped brackets 34*a*, 34*b*. Thus, the cap plates 42*a*, 42*b* secure the movable U-shaped brackets 34*a*, 34*b* in a slidable relation.

Each holder 12 also includes gear means which may be manually moved for causing longitudinal movement of the two support arms 32*a*, 32*b* between the closely spaced apart and widely spaced apart positions. This gear means includes a pinion gear 46 which is rotatably mounted to the base plate 20 so as to overlie the support surface 21 of the base plate. The pinion gear 46 rotates about the axis defined by the opening 26, and which is perpendicular to the support surface 21 of the base plate. Also, the pinion gear 46 is positioned between and operatively engages the gear racks 40*a*, 40*b* of the guide arms 36*a*, 36*b*. Thus, rotation of the pinion gear 46 causes a longitudinal movement of the gear racks 40*a*, 40*b* and thus the support arms 32*a*, 32*b* in opposite directions.

The pinion gear 46 is rotatably mounted to the base plate by means of a bolt 48 which extends through the opening 26 in the support surface 21. The bolt 48 includes a head 49, a threaded portion 50 which extends from one side of the head, and a shaft portion 51 which extends from the other side of the head and through a bearing opening 52 in the pinion gear 46, and so as to define a rotational axis which is perpendicular to the base surface 21. Also, a retaining clip 53 serves to retain the pinion gear 46 on the bolt 48, note FIG. 5.

The head 49 of the bolt 48 is received in a counterbored position of the opening 26, and a retainer clip 54 is positioned to engage the bolt and the bottom surface of the cylindrical collar 30 of the base plate 20. Thus the bolt is secured to the base plate 20.

Figure 2:
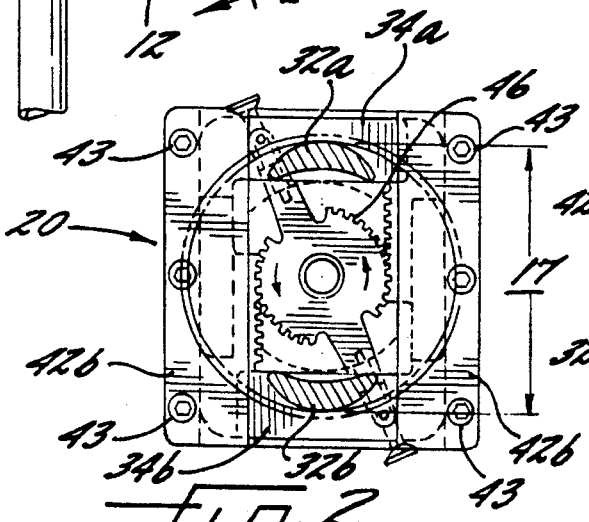
FIG. 2 is a top plan view looking along the line 2—2 of FIG. 1 and illustrates an adjustable yarn package holder according to the invention with its elongate support arms in a widely spaced apart position.
Figure 3:
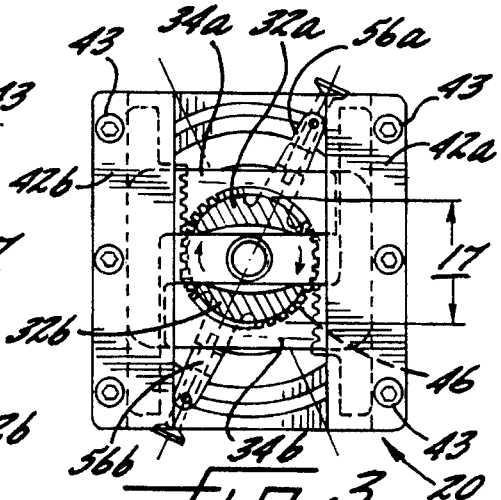
FIG. 3 is a top plan view looking along the line 3—3 of FIG. 1 and illustrates an adjustable yarn package holder according to the invention with its elongate support arms in a closely spaced apart position.

As shown in FIG. 2, by rotating the pinion gear 46 in a counter clockwise direction, the elongate support arms 32*a*, 32*b* move to a widely spaced apart position. Conversely, as shown in FIG. 3, by rotating the pinion gear 46 in a clockwise direction, the elongate support arms 32*a*, 32*b* move to a closely spaced apart position.

Figure 4:
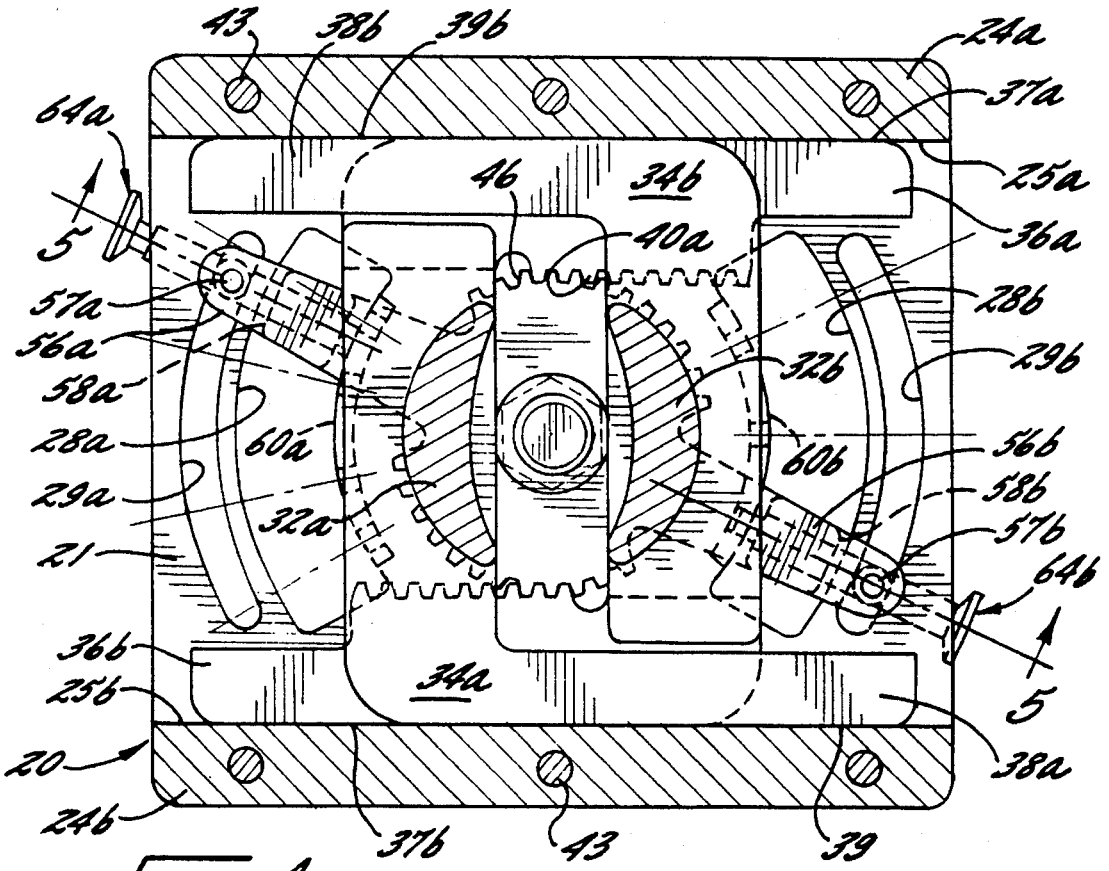
FIG. 4 is a cross-sectional view along the line 4—4 of FIG. 1 and illustrates the rack and pinion gear mechanism of the adjustable yarn package holder according to the invention.

A pair of lever arms 56*a*, 56*b* are fixed to opposite sides of the pinion gear 46 and extend radially therefrom, as shown most clearly in FIGS. 4 and 6. Each lever arm 56*a*, 56*b* defines a radial extremity which is moveable to cause rotation of the pinion gear 46 about the axis of the bolt 48. The radial extremities each mount a depending guide pin 57*a*, 57*b* which is slideably received in a respective one of the second pair of arcuate openings 29*a*, 29*b* in the support surface 21 of the base plate, note FIG. 5, for controlling the radial movement of the lever arms. Also, each radial extremity includes a mounting block 58*a*, 58*b* which extends downwardly through a respective one of the first pair of arcuate openings 28*a*, 28*b* in the support surface. The mounting blocks 58*a*, 58*b* are thus disposed immediately adjacent the outer surface of the cylindrical collar 30 of the base plate.

A position locking system is used for releasably locking each of the elongate support arms 32*a*, 32*b* in any one of a plurality of positions at or between the first closely spaced apart position and the second widely spaced apart position. Accordingly, the spacing between the elongate support arms 32*a*, 32*b* may be selectively fixed to define a plurality of different cross-sectionally sized mandrels for receiving one of a plurality of yarn packages 16 having a plurality of differently sized cores 17. The position locking system includes two shoe plates 60*a*, 60*b* which define outer surface segments and which are removably mounted to the outer periphery of the cylindrical collar 30 of the base plate by screws, and so as to be concentric with respect to the axis of the bolt 48 and opening 26. Each of the shoe plates 60*a*, 60*b* is a segment of a circle when viewed in side elevation, and they are generally aligned on the inside of respective ones of the first pair of openings 28*a*, 28*b*. The shoe plates 60*a*, 60*b* include a plurality of preferably radial openings 62 therein and which are disposed along a line extending circumferentially about the axis of the bolt 48 and opening 26.

The position locking system also includes a pair of spring plunger assemblies 64*a*, 64*b* which are respectively mounted to the mounting blocks 58*a*, 58*b*, for selectively engaging one of the openings 62 in the adjacent shoe plate 60*a*, 60*b*. Each plunger assembly 64*a*, 64*b* includes an outer sleeve 65 which is threadedly joined to the associated mounting block, and a spring biased plunger 66 which engages in a selected one of the openings 62 in the adjacent shoe plate.

Since the shoe plates 60*a*, 60*b* are removably mounted to the base plate 20, they are subject to removal and replacement with shoe plates having a different pattern of the radial openings 62. Also, it will be understood that the spacing and placement of the openings 62 in the two shoe plates may be selected so that the openings of one shoe plate are engaged by its associated plunger assembly while the openings of the other shoe plate are not so engaged. By this arrangement, the number of selectable positions between the closed spaced apart position and the widely spaced apart position of the support arms 32*a*, 32*b* may be increased. If desired, both shoe plates may be used for a particular setting, but this will reduce the number of selections.

As best seen in FIG. 1, each yarn package holder 12 is mounted on its supporting post 14 of the creel 10 by an arrangement which includes a bracket 68 which is fixed to the post. The bracket 68 in turn mounts a sleeve 70 which coaxially receives the bolt 48 of the holder 12, and the bolt 48 is secured in the sleeve 70 by means of a removable nut 71. The bracket 68 is of a construction similar to those presently used to secure the fixed mandrels to the post of the creel, and this fact facilitates the retrofitting of a creel of the conventional construction as described above, with the yarn package holder 12 of the present invention.

In the drawings and specification, there has been disclosed the preferred embodiment of the invention. Although while a specific description is presented and specific terms are employed, they are used in a generic and descriptive sense only and not for purposes of limitation. Thus for example, while in the specifically disclosed embodiment, both of the support arms are moveable toward and away from each other, the holder could be designed so that only one of the support arms moves while the other remains stationary.

That which is claimed:

1. A yarn package holder for supporting one of a plurality of variously sized yarn packages on a creel, the variously sized yarn packages having internal cores of different diameters, said yarn package holder comprising:

a base plate including a planar support surface which defines a longitudinal direction and a shoulder formed on said base plate so as to define a guide edge which is perpendicular to and extends longitudinally along one side of said support surface;

a pair of elongate support arms which define a mandrel for receiving a core of a yarn package thereon;

mounting means for mounting said elongate support arms to said base plate with said elongate support arms extending outwardly from said support surface, and with at least one of said elongate support arms being moveable longitudinally toward and away from the other support arm such that the elongate support arms may be selectively moved between a first closely spaced apart position and a second widely spaced apart position to define different cross-sectional sizes of mandrels for receiving yarn packages having cores of different diameters, said mounting means comprising a guide arm fixed to said at least one elongate support arm and resting upon said support surface, said guide arm including a first longitudinally directed side edge which directly opposes and slideably engages said guide edge of said base plate, and a second longitudinally directed side edge which faces away from said guide edge of said base plate, and with said second side edge having a gear rack fixed thereon;

gear means operatively engaging said mounting means and which may be moved for causing longitudinal movement of said at least one support arm, said gear means comprising a pinion gear rotatably mounted to said base plate so as to overlie said support surface and for rotation about an axis which is substantially perpendicular to said support surface, and with said pinion gear being positioned so as to operatively engage said gear rack of said guide arm, and such that rotation of said pinion gear causes a longitudinal movement of said gear rack and said at least one support arm; and a lever arm fixed to said pinion gear and extending radially therefrom so as to define a radial extremity, and whereby the radial extremity of said lever arm may be moved to cause rotation of said pinion gear about said axis and thus movement of said at least one support arm between said first closely spaced apart position and said second widely spaced apart position, and locking means for releasably locking said at least one elongate support arm in any one of a plurality of positions at or between said first closely spaced apart position and said second widely spaced apart position so as to permit the spacing between said elongate support arms to be selectively fixed to define a plurality of different cross-sectionally sized mandrels for receiving any one of a plurality of yarn packages having a plurality of differently sized cores, said locking means comprising:

(a) a surface segment connected to said base plate, said surface segment having a plurality of openings formed therein;

(b) a mounting block fixed to said radial extremity of said lever arm and positioned to overlie said surface sediment; and (c) spring plunger assembly means mounted to said mounting block for selectively engaging one of said openings in said surface segment.

2. A yarn package holder according to claim 1 wherein said surface segment comprises a shoe plate which is removably mounted to said base plate so as to facilitate the removal and replacement of the shoe plate with a shoe plate having a different pattern of said openings therein.

3. A yarn package holder according to claim 1 and further comprising attachment means connected to said base plate for releasably attaching said yarn package holder to a vertical post of a yarn package supporting creel or the like.

4. A yarn package holder according to claim 3 wherein said base plate further includes a rear surface which faces oppositely from said support surface, and wherein said attachment means comprises a bolt fixed to said base plate and extending outwardly from said rear surface.

5. The yarn package holder according to claim 9 wherein said bolt includes a shaft portion which extends coaxially along said axis and which serves to rotatably mount said pinion gear on said base plate.

6. A yarn package holder for supporting one of a plurality of variously sized yarn packages on a creel, the variously sized yarn packages having internal cores of different diameters, said yarn package holder comprising:

a base plate including a planar support surface which defines a longitudinal direction and a pair of shoulders formed along opposite sides of said base plate so as to define a pair of opposing guide edges on said base plate, and with each of said opposing guide edges being disposed perpendicular to said support surface and extending longitudinally along the associated side of said base plate;

a pair of elongate support arms which define a mandrel to receive a core of a yarn package thereon;

mounting means for mounting said elongate support arms to said base plate with said elongate support arms extending outwardly from said support surface, and with each of said elongate support arms being moveable longitudinally toward and away from the other elongate support arm such that the elongate support arms may be selectively moved between a first closely spaced apart position and a second widely spaced apart position, said mounting means comprising a pair of U-shaped brackets, each U-shaped bracket being fixed to a respective one of said elongate support arms, and with each of said U-shaped brackets including:

(a) a first guide arm having a first longitudinally directed side edge which directly opposes and slideably engages one of said guide edges of said base plate, and (b) a second guide arm having a second longitudinally directed side edge which directly opposes and slideably engages the other of said guide edges of said base plate, said U-shaped brackets overlying said support surface and partially overlying each other and being disposed in an oppositely directed orientation;

said mounting means further comprising a pair of gear racks, and with each of said gear racks being formed on a respective one of said guide arms on a respective one of said U-shaped brackets such that the gear racks face each other;

gear means rotatably mounted to said base plate and operatively engaging said mounting means such that rotation of said gear means causes longitudinal movement of said elongate support arms in opposite directions between said first closely spaced apart position and said second widely spaced position, said gear means comprising a pinion gear rotatably mounted on said base plate so as to overlie said support surface and rotate about an axis substantially perpendicular to said support surface, said pinion gear being positioned so as to be between and operatively engage each of said gear racks, such that rotation of said pinion gear about said axis causes a longitudinal movement of said elongate support arms in opposite directions; and locking means for releasably locking each of said elongate support arms in any one of a plurality of positions at or between said first closely spaced apart position and said second widely spaced apart position so as to permit the spacing between said elongate support arms to be selectively fixed to define a plurality of different cross-sectionally sized mandrels for receiving one of a plurality of yarn packages having a plurality of differently sized cores, and attachment means fixed to said base plate for releasably mounting said yarn package holder to a creel, said attachment means comprising a bolt fixed to said base plate and extending outwardly from the surface thereof opposite said support surface, and with said bolt including a shaft portion which extends coaxially along said axis and which serves to rotatably mount said pinion gear on said base plate.

7. A yarn package holder according to claim 6 further comprising a pair of lever arms fixed to opposite sides of said pinion gear and extending radially therefrom such that each lever arm defines a radial extremity, the radial extremity of each lever arm being moveable to cause rotation of said pinion gear about said axis and thereby move said elongate support arms between said first closely spaced apart position and said second widely spaced apart position.

8. A yarn package holder according to claim 7 wherein said locking means comprises:

a pair of cylindrical surface segments mounted on said base plate so as to be concentric with respect to said axis, and with each of said cylindrical surface segments being generally aligned with a respective one of said lever arms and having a plurality of radial openings formed therein along a line extending circumferentially about said axis;

a pair of mounting blocks, each mounting block being fixed to a respective radial extremity of said pair of lever arms and being positioned to overlie the associated cylindrical surface segment; and a pair of spring plunger assembly means, each spring plunger assembly means being mounted to a respective mounting block, for selectively engaging one of said openings in the associated cylindrical surface segment.

9. A yarn package holder according to claim 8 wherein each of said cylindrical surface segments comprises a shoe plate which is removably mounted to said base plate so as to facilitate the removal and replacement of each shoe plate with a shoe plate having a different pattern of said radial openings therein.

10. A creel for supporting a plurality of yarn packages and so as to be adapted to supply a plurality of yarns to a textile machine comprising:

at least one vertical post, a plurality of yarn package holders, with each yarn package holder comprising (a) a base plate mounted to said creel and including a planar support surface which defines a longitudinal direction, and a shoulder formed on said base plate so as to define a guide edge which is perpendicular to and extends longitudinally along one side of said support surface;

(b) a pair of elongate support arms which define a mandrel for receiving a core of a yarn package thereon;

(c) mounting means for mounting said elongate support arms to said base plate with said elongate support arms extending outwardly from said support surface, and with at least one of said elongate support arms being moveable longitudinally toward and away from the other support arm such that the elongate support arms may be selectively moved between a first closely spaced apart position and a second widely spaced apart position to define different cross-sectional sizes of mandrels for receiving yarn packages having cores of different diameters, and said mounting means comprising a guide arm fixed to said at least one elongate support arm and resting upon said support surface, said guide arm including a first longitudinally directed side edge which directly opposes and slideably engages said guide edge of said base plate, and a second longitudinally directed side edge which faces away from said guide edge of said base plate, and with said second side edge having a gear rack fixed thereon;

(d) gear means operatively engaging said mounting means and which may be moved for causing longitudinal movement of said at least one support arm, said gear means comprising a pinion gear rotatably mounted to said base plate so as to overlie said support surface and for rotation about an axis which is substantially perpendicular to said support surface, and with said pinion gear being positioned so as to operatively engage said gear rack of said guide arm, and such that rotation of said pinion gear causes a longitudinal movement of said gear rack and said at least one support arm; and (e) locking means for releasably locking said at least one elongate support arm in any one of a plurality of positions at or between said first closely spaced apart position and said second widely spaced apart position so as to permit the spacing between said elongate support arms to be selectively fixed to define a plurality of different cross-sectionally sized mandrels for receiving any one of a plurality of yarn packages having a plurality of differently sized cores; and means mounting each of said yarn package holders to said post in a vertically spaced apart arrangement and with said mandrels extending in a generally horizontal direction, and comprising a bracket mounted to said post, and a bolt fixed to said base plate of the associated yarn package holder and being threadedly connected to said bracket.

11. The creel according to claim 10 wherein each of said yarn package holders further comprises a lever arm fixed to said pinion gear and extending radially therefrom so as to define a radial extremity, and whereby the radial extremity of said lever arm may be moved to cause rotation of said pinion gear about said axis and thus movement of said at least one support arm between said first closely spaced apart position and said second widely spaced apart position.

12. The creel according to claim 11 wherein said locking means of each of said yarn package holders comprises:

a surface segment connected to said base plate, said surface segment having a plurality of openings formed therein;

a mounting block fixed to said radial extremity of said lever arm and positioned to overlie said surface segment; and spring plunger assembly means mounted to said mounting block for selectively engaging one of said openings in said surface segment.

13. The creel according to claim 12 wherein said surface segment comprises a shoe plate which is removably mounted to said base plate so as to facilitate the removal and replacement of the shoe plate with a shoe plate having a different pattern of said openings therein.

14. The creel according to claim 10 wherein said bolt of each of said yarn package holders includes a shaft portion which extends coaxially along said axis and which rotatably mounts said pinion gear on said base plate.

15. A yarn package holder for supporting one of a plurality of variously sized yarn packages on a creel, the variously sized yarn packages having internal cores of different diameters, said yarn package holder comprising:

a base plate including a planar support surface which defines a longitudinal direction and a shoulder formed on said base plate so as to define a guide edge which is perpendicular to and extends longitudinally along one side of said support surface;

a pair of elongate support arms which define a mandrel for receiving a core of a yarn package thereon;

mounting means for mounting said elongate support arms to said base plate with said elongate support arms extending outwardly from said support surface, and with at least one of said elongate support arms being moveable longitudinally toward and away from the other support arm such that the elongate support arms may be selectively moved between a first closely spaced apart position and a second widely spaced apart position to define different cross-sectional sizes of mandrels for receiving yarn packages having cores of different diameters, said mounting means comprising a guide arm fixed to said at least one elongate support arm and resting upon said support surface, said guide arm including a first longitudinally directed side edge which directly opposes and slideably engages said guide edge of said base plate, and a second longitudinally directed side edge which faces away from said guide edge of said base plate, and with said second side edge having a gear rack fixed thereon;

gear means operatively engaging said mounting means and which may be moved for causing longitudinal movement of said at least one support arm, said gear means comprising a pinion gear rotatably mounted to said base plate so as to overlie said support surface and for rotation about an axis which is substantially perpendicular to said support surface, and with said pinion gear being positioned so as to operatively engage said gear rack of said guide arm, and such that rotation of said pinion gear causes a longitudinal movement of said gear rack and said at least one support arm;

a lever arm fixed to said pinion gear and extending radially therefrom so as to define a radial extremity, and whereby the radial extremity of said lever arm may be moved to cause rotation of said pinion gear about said axis and thus movement of said at least one support arm between said first closely spaced apart position and said second widely spaced apart position; and attachment means fixed to said base plate for releasably mounting said yarn package holder to a supporting structure, said attachment means comprising a bolt fixed to said base plate and extending outwardly from the surface thereof opposite said support surface, and with said bolt including a shaft portion which extends coaxially along said axis and which serves to rotatably mount said pinion gear on said base plate.

* * * * *